US007082875B2

(12) United States Patent
Sugimoto et al.

(10) Patent No.: US 7,082,875 B2
(45) Date of Patent: Aug. 1, 2006

(54) DUST COLLECTION APPARATUS OF PRINTING PRESS

(75) Inventors: Ikuo Sugimoto, Toride (JP); Koji Takeda, Toride (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 10/941,938

(22) Filed: Sep. 16, 2004

(65) Prior Publication Data

US 2005/0056178 A1 Mar. 17, 2005

(30) Foreign Application Priority Data

Sep. 17, 2003 (JP) ..... 2003-323979

(51) Int. Cl.
*B41F 35/00* (2006.01)

(52) U.S. Cl. ..... 101/424.2; 101/416.1

(58) Field of Classification Search ..... 101/424.2, 101/419, 420, 416, 416.1
See application file for complete search history.

(56) References Cited

U.S. PATENT DOCUMENTS 5,265,536 A * 11/1993 Millard ..... 101/424.2
5,931,095 A * 8/1999 Platsch ..... 101/424.2
6,038,998 A * 3/2000 Platsch ..... 118/46
6,877,247 B1 * 4/2005 DeMoore ..... 34/269
2001/0042472 A1 * 11/2001 Muller et al. ..... 101/424
2001/0050012 A1 * 12/2001 Koch ..... 101/232

FOREIGN PATENT DOCUMENTS

| | | | |
|---|---|---|---|
| BE | 507920 | A | 5/1953 |
| DE | 2207983 | A | 8/1973 |
| JP | 2578195 | Y2 | 5/1998 |
| JP | 2001-1496 | A | 1/2001 |

* cited by examiner

*Primary Examiner*—Anthony H. Nguyen
(74) *Attorney, Agent, or Firm*—Birch, Stewart, Kolasch & Birch, LLP

(57) ABSTRACT

A dust collection apparatus of a printing press comprises: delivery chains equipped with gripper devices for holding a printed sheet; spray nozzles for spraying a powder toward a printed surface of the sheet being transported by the delivery chains; a blowing device, provided downstream of the spray nozzles in a sheet transport direction, for blowing air nearly parallel to the printed surface of the sheet being transported and toward an upstream side in the sheet transport direction; and a suction duct, provided upstream of the blowing device in the sheet transport direction, for sucking the powder along with air blown by the blowing device.

12 Claims, 9 Drawing Sheets

DUST COLLECTION APPARATUS OF PRINTING PRESS

CROSS REFERENCE TO RELATED APPLICATION

The entire disclosure of Japanese Patent Application No. 2003-323979 filed on Sep. 17, 2003, including specification, claims, drawings and summary, is incorporated herein by reference in its entirety.

BACKGROUND OF THE INVENTION

1. Field of the Invention

This invention relates to a dust collection apparatus for collecting dust, such as paper dust or powder, which occurs during an operation of a printing press or the like.

2. Description of the Related Art

This type of dust collection apparatus is typified most by a dust collection apparatus in a sheet-fed rotary press. That is, a sheet-fed rotary press applies printing to paper cut to a predetermined size. FIG. 8 shows a sheet-fed rotary press, in which sheets fed from a feeder (not shown) and printed by a printing section of a printing unit are transported to a delivery 100, and stacked in layers on a pile board 101. The sheets 102 stacked on the pile board 101, which have just undergone printing, have ink on their sheet surface insufficiently dried. Since the sheets 102 are stacked, one after another, in such an insufficiently dry state, so-called blocking, in which an image printed on the sheet 102 is transferred to the back of the sheet 102 placed directly above the lower sheet 102, occurs under the own weight of the sheet 102, or because of a slight impact caused by a falling sheet 102. This blocking phenomenon contaminates the back of the sheet 102, and peels off the ink applied onto the printed surface. Hence, the commercial value of printing products is markedly diminished.

To prevent this event, the printed surface of the sheet 102 is sprayed with a powder by a spray nozzle 103, as shown in FIG. 9, immediately before the sheet 102 is placed on the pile on the pile board 101, whereby a clearance corresponding to the particle diameter of a powder 104 is formed between the sheet 102 and the sheet 102, as shown in FIG. 10. The powder 104 is mainly composed of corn starch, and its particles have diameters of about 10 to 30 μm. On the other hand, the film thickness of the ink 105 printed on the sheet surface is about 1 to 2 μm. Thus, the particles of the powder ensure sufficient clearance. The powder spraying device disclosed there is an indispensable device for printing by a sheet-fed rotary press, unless a special device, such as an ultraviolet (UV) dryer, is provided.

Powder spraying by the spray nozzle 103 is performed for the sheet 102 being transported by a gripper device 107 (composed of a gripper 107*a* and a gripper pad 107*b*) of a delivery chain 106 in the delivery 100 (see FIGS. 8 and 9). In this case, the transport speed of the sheet 102 is about 3 m/s, and the distance between the spray nozzle 103 and the sheet 102 during powder spraying is about 0.1 m. In powder spraying work carried out at such a transport speed of the sheet 102 and over such a spraying distance, it is impossible for 100% of the sprayed powder 104 to adhere to the sheet surface. Normally, the amount of the powder 104 adhering to the sheet 102 is in the order of 10 to 30%, at most, based on the total amount of the sprayed powder 104. The remaining 70 to 90% of the sprayed powder scatters over the surroundings of the powder spraying device.

The scattered powder not only harms the work environment, but also deposits on stays, etc. within the printing press over time. The deposited powder cannot support its own weight, and collapses, falling as a lump over the printing product, thereby causing a printing trouble called "lumpy deposits." The lumpy deposits occur abruptly, and are thus difficult to find, for example, by product inspection. It is extremely difficult to eliminate this trouble completely. For the purpose of preventing the lumpy deposits, a sheet-fed rotary press is furnished with a dust collection apparatus for sucking and removing the scattered powder.

The dust collection apparatus is of a common type called a bag filter. This collection apparatus has a dust collector body housing a blower, a filter, etc., and a suction duct leading from the dust collector body. The suction duct is disposed in place within the printing press.

A conventional technique for enhancing the dust collecting effect of the dust collection apparatus is disclosed in Japanese Utility Model Registration No. 2578195 (hereinafter referred to as Patent Document 1) According to a dust collection apparatus disclosed there, the neighborhood of a spray nozzle is surrounded by a shielding plate and a brush, and a powder is collected from within a range surrounded by the shielding plate and the brush so that air with a high dust concentration can be sucked. By so doing, the efficiency of the dust collection apparatus is increased.

With the above-described conventional apparatus, a clearance as large as 100 mm, at the smallest, must be formed between the shielding plate and a sheet guide, in order to avoid interference between the delivery gripper device and the shielding plate. The powder leaks through this clearance. To overcome this problem, the brush, which can be instantaneously rendered upright or lying, is used to close the clearance.

The brush, however, has been ineffective in that it cannot shut off the aforementioned range completely. Along the path of the delivery chain, in particular, a strong airflow (see Karman vortices α, β in FIG. 7) is created by the continuous running of a gripper bar 108 (composed of a gripper shaft 108*a* and a gripper pad shaft 108*b*) on which the gripper device 107 is mounted, as shown in FIG. 7. Borne by this airflow, a large amount of surplus powder is carried beyond the range surrounded by the shielding plate and the brush. To enhance the shielding effect, bristles of the brush may be elongated to decrease the clearance between the brush and the sheet guide. Too small a clearance, however, may result in the contact of the brush with the sheet surface, damaging the printed surface.

As shown in FIG. 8, the surplus powder is borne by the airflow created by the continuous travel of the gripper device 107 and the gripper bar 108, and is transported to an upper portion of the delivery 100. At the upper portion of the delivery 100, the surplus powder is blown downward by an air blower 110 comprising fans or the like for dropping the sheet 102 onto the pile board 101. Then, the surplus powder is flown outside through a lower opening portion of the delivery 100 (see downward arrows in FIG. 8). This flow of the surplus powder cannot be eradicated by the apparatus disclosed in the aforementioned Patent Document 1.

SUMMARY OF THE INVENTION

The present invention has been accomplished in light of the above-mentioned circumstances. The invention provides a dust collection apparatus of a printing press, the dust collection apparatus being capable of effectively reducing the amount of a surplus powder, which is borne by an airflow created by the travel of sheet holding means, and is carried downstream in the direction of paper transport, thereby increasing the efficiency of the dust collection apparatus. p According to the invention for attaining the above-mentioned object, there is provided a dust collection apparatus of a printing press, comprising:

sheet transport means equipped with sheet holding means for holding a printed sheet;

powder spraying means for spraying a powder toward a printed surface of the sheet being transported by the sheet transport means;

blowing means, provided downstream of the powder spraying means in a sheet transport direction, for blowing air nearly parallel to the printed surface of the sheet being transported and toward an upstream side in the sheet transport direction; and first suction means, provided upstream of the blowing means in the sheet transport direction, for sucking the powder along with air blown by the blowing means.

According to the present invention having the above-described features, the amount of a surplus powder, which has been borne by an airflow created by the movement of the sheet holding means, and carried to a downstream side in the sheet transport direction, is effectively decreased by air blown nearly parallel to the printed surface of a sheet being transported and toward an upstream side in the sheet transport direction. Thus, the efficiency of the dust collection apparatus is increased.

The first suction means may be provided downstream of the powder spraying means in the sheet transport direction.

The first suction means may be connected to a dust collector body.

The dust collection apparatus may further comprise second suction means, provided beside opposite side end portions of the sheet being transported by the sheet holding means, for sucking the powder.

The dust collection apparatus may further comprise a sheet guide portion, provided between the second suction means provided beside the opposite side end portions of the sheet being transported by the sheet holding means, for guiding the sheet being transported, the sheet guide portion having discharge holes for discharging air to the second suction means which are closer to the sheet guides with respect to a nearly central portion thereof.

The second suction means may be connected to a dust collector body.

Suction holes of the first suction means may be directed toward an upstream side in the sheet transport direction.

Alternatively, suction holes of the first suction means may be directed toward a downstream side in the sheet transport direction.

The blowing means may be fans rotationally driven by a motor, and the motor may have a speed controlled in accordance with the printing speed of the printing press.

The dust collection apparatus may further comprise brushes provided upstream of the powder spraying means in the sheet transport direction and downstream of the powder spraying means in the sheet transport direction.

The blowing means, the first suction means, and the powder spraying means may be provided to face one surface of the sheet being transported by the sheet holding means, while the sheet guide portion and the second suction means may be provided to face the other surface of the sheet being transported by the sheet holding means.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

A dust collection apparatus of a printing press according to the present invention will now be described in detail by embodiments with reference to the accompanying drawings, but the invention is in no way limited by the embodiments.

Embodiment 1

Figure 1:
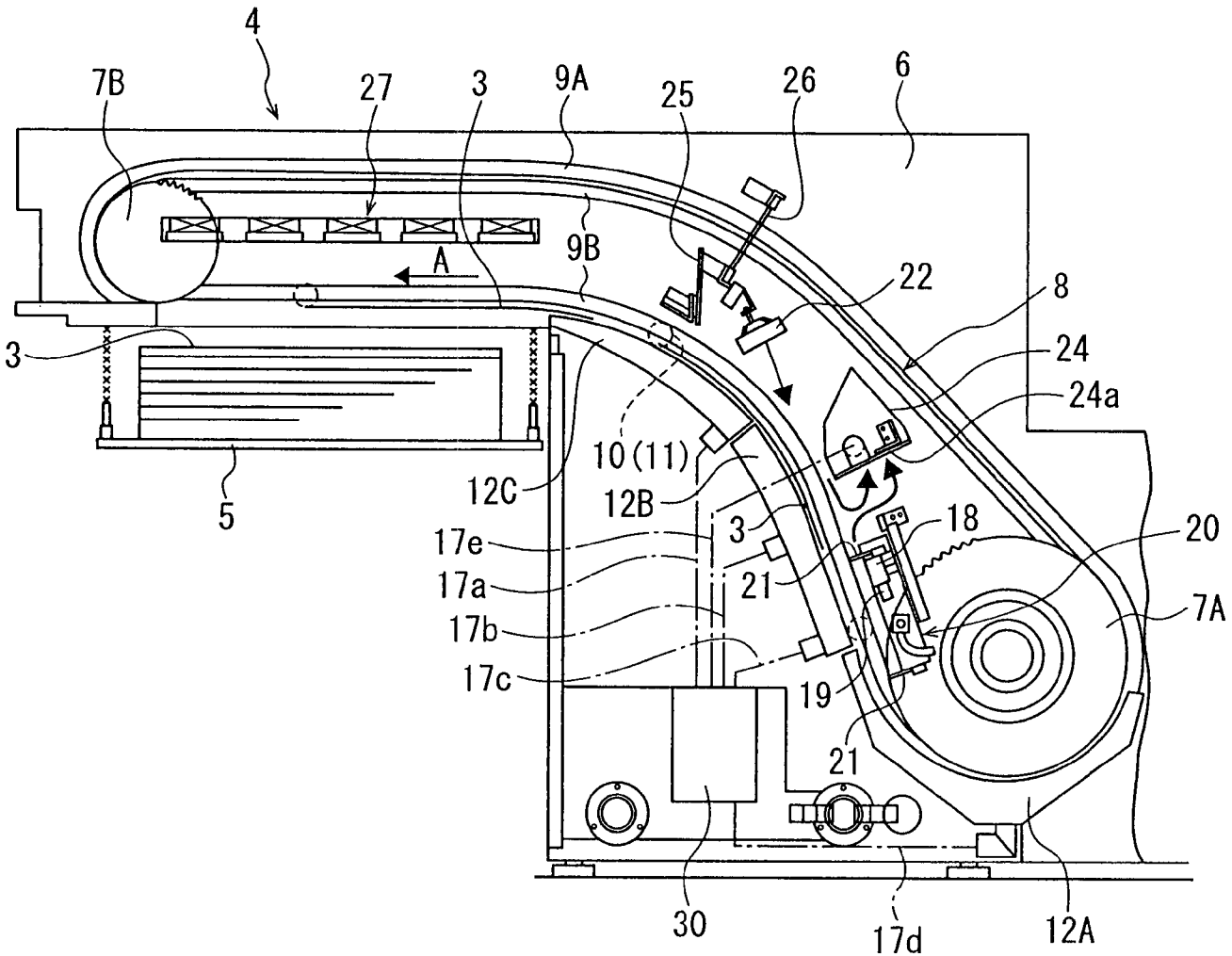
FIG. 1 is a detail side view of a delivery of a sheet-fed rotary press showing Embodiment 1 of the present invention.
Figure 2:
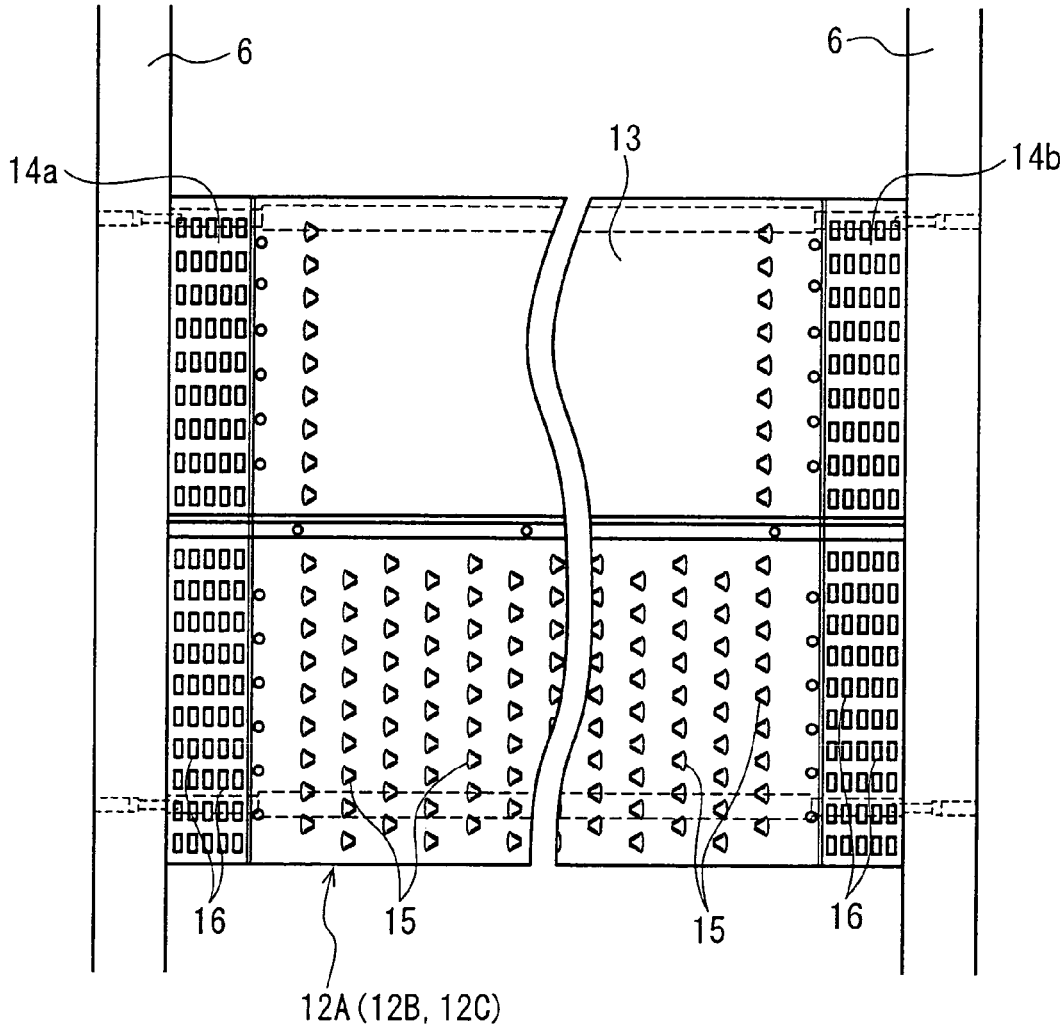
FIG. 2 is a plan view of a sheet guide.
Figure 3:
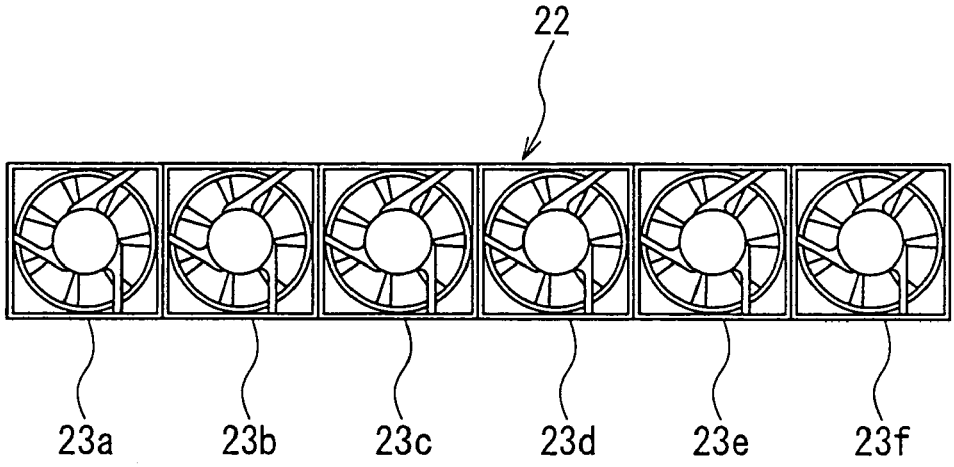
FIG. 3 is a front view of a blowing device.
Figure 4:
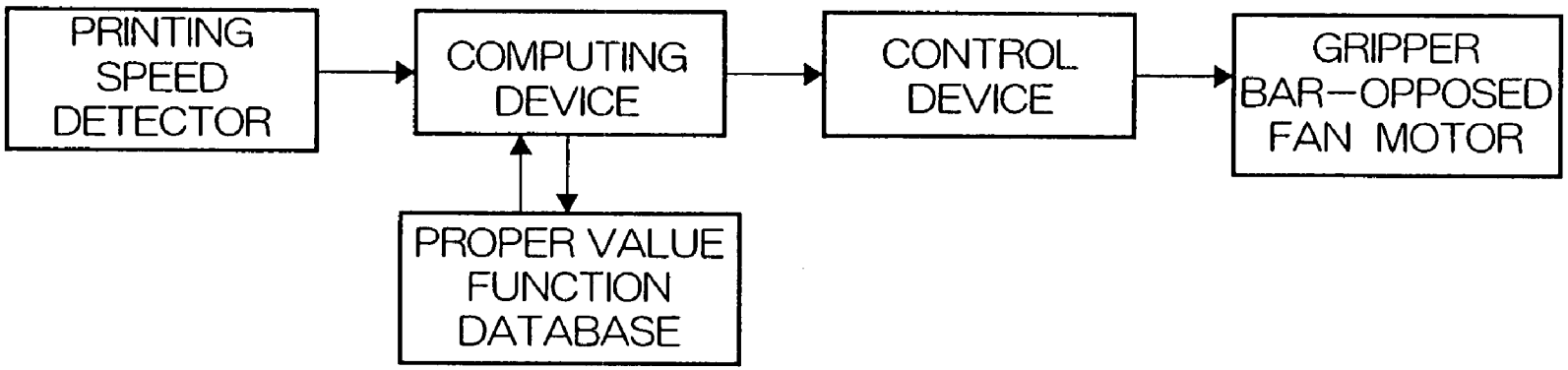
FIG. 4 is a block diagram of gripper bar-opposed fan rotation control.
Figure 5:
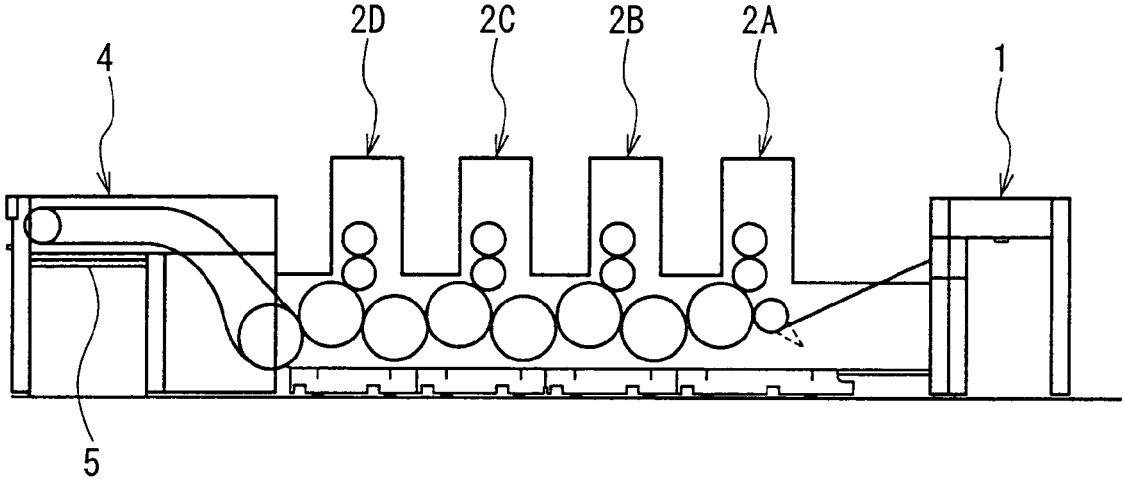
FIG. 5 is a general configurational drawing of the sheet-fed rotary press.

FIG. 1 is a detail side view of a delivery of a sheet-fed rotary press showing Embodiment 1 of the present invention. FIG. 2 is a plan view of a sheet guide. FIG. 3 is a front view of a blowing device. FIG. 4 is a block diagram of gripper bar-opposed fan rotation control. FIG. 5 is a general configurational drawing of the sheet-fed rotary press.

In a sheet-fed rotary press, as shown in FIG. 5, sheets 3 (see FIG. 1) fed from a feeder 1 and printed by printing units 2A, 2B, 2C, 2D having four colors are transported to a delivery (delivery unit) 4, and stacked in layers on a pile board 5.

The delivery 4, as shown in FIG. 1, is provided with a pair of (i.e., right and left) frames 6, which are formed in a nearly inverted L-shape and connected together by stays (not shown). A pair of (i.e., front and rear) sprockets 7A and 7B are rotatably supported by these frames 6. Delivery chains (sheet transport means) 8, which travel in the direction of sheet transport (sheet transport direction), indicated by an arrow A in FIG. 1, in accordance with the rotation of the sprocket 7A driven from a drive side, are looped between the sprockets 7A and 7B. The delivery chain 8 has its travel guided in such a manner as to be held between an endless chain guide 9A and chain guides 9B having ends.

Figure 7:
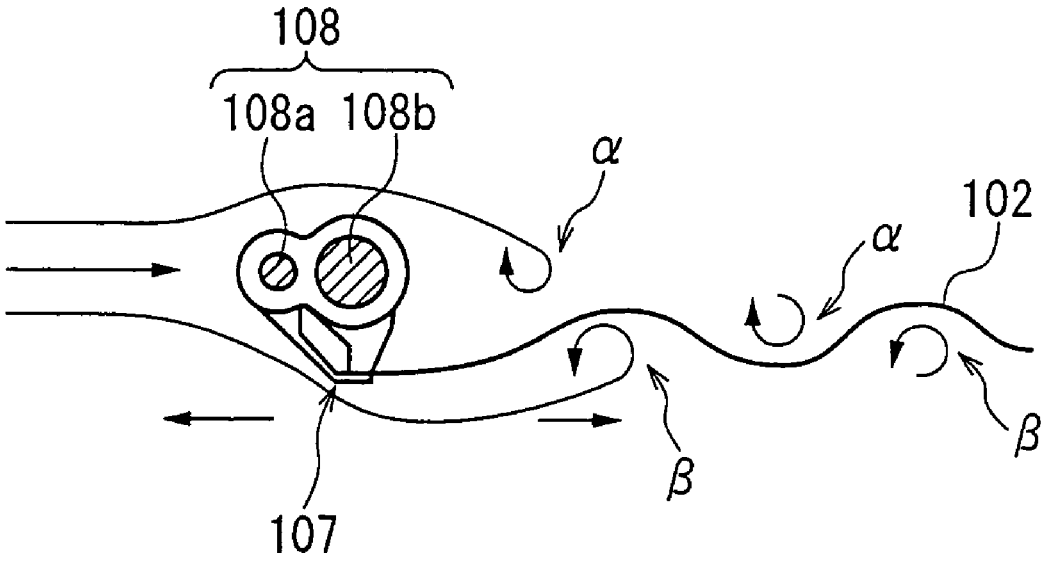
FIG. 7 is an explanation drawing of an airflow created by the movement of a gripper bar.
Figure 8:
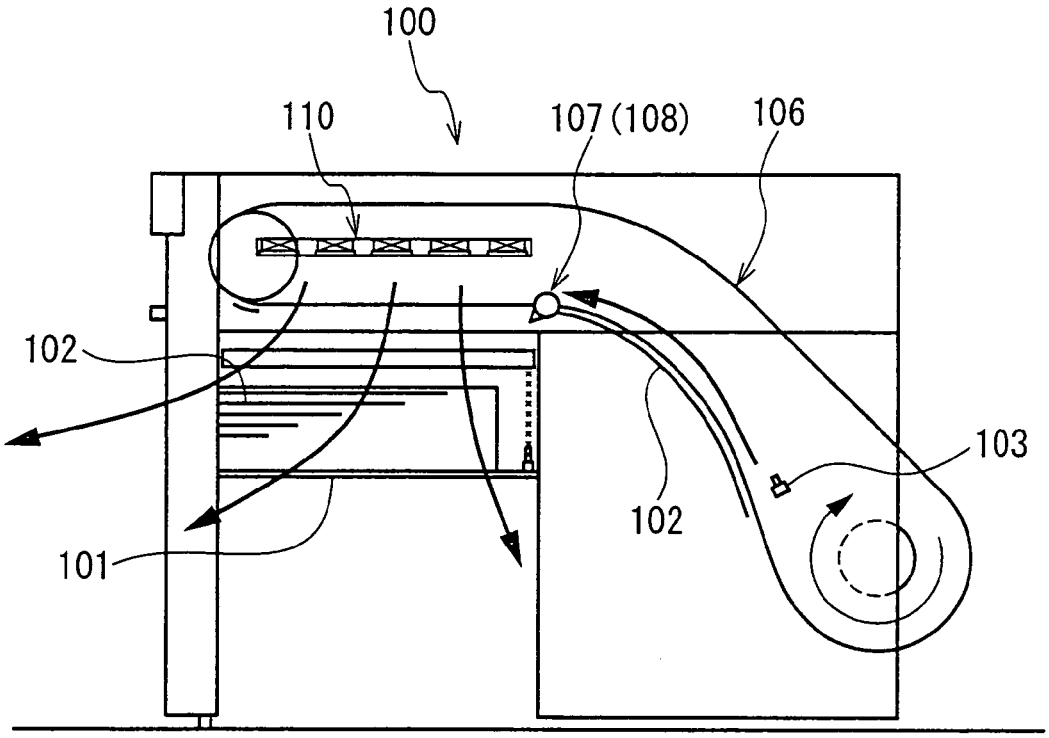
FIG. 8 is a detail side view of a delivery of a conventional sheet-fed rotary press.
Figure 9:
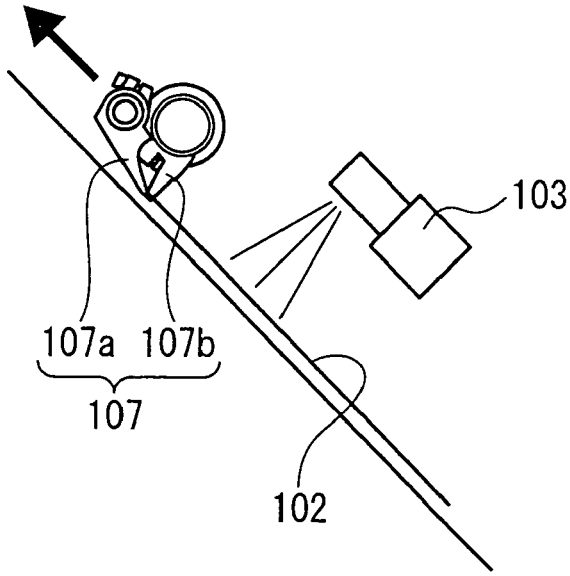
FIG. 9 is an explanation drawing of powder spraying.
Figure 10:
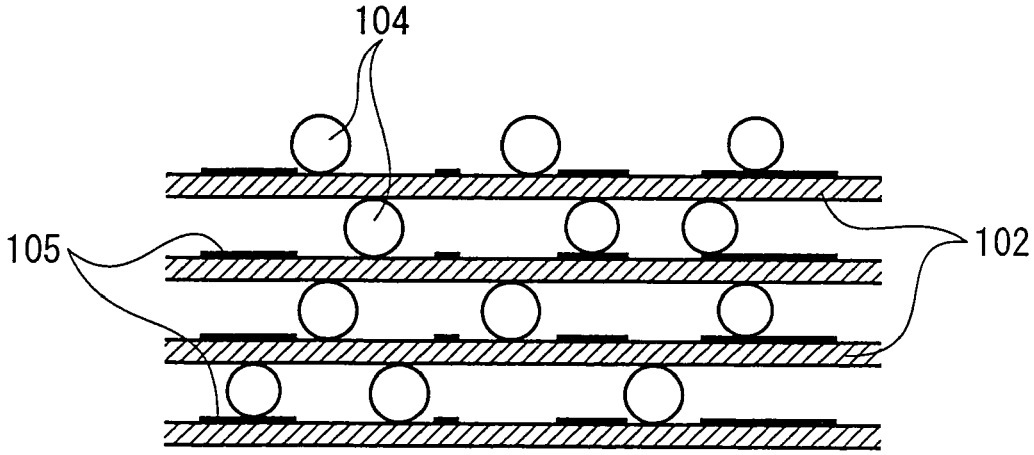
FIG. 10 is a schematic view of a powder for preventing setoff.

A plurality of gripper bars 10 (see FIG. 7), each comprising a gripper shaft and a gripper pad shaft, are supported at constant intervals between the right and left delivery chains 8. A plurality of gripper devices (sheet holding means, see FIG. 9) 11, each consisting of a gripper and a gripper pad, are arranged parallel in the axial direction on these gripper bars 10. The sheet 3, whose front end portion has been transferred from the gripper devices provided in the final cylinder of the printing unit 2D to the gripper devices 11 of the delivery chains 8 by gripping change, is transported as the gripper devices 11 travel.

Below the transport path of the sheet 3, casing-shaped sheet guides 12A, 12B, and 12C, provided as three divisional bodies in the transport direction of the sheet 3, are supported along the transport direction to float the transported sheet 3 by air fed through blowoff holes 15 (to be described later).

The above sheet guides 12A, 12B, 12C, as shown in FIG. 2, each have a central portion accounting for most of the area of the sheet guide, as viewed in plan, and right and left end portions. The central portion is composed of an air discharge duct 13 connected appropriately to an air supply source (not shown) by hoses. The right and left end portions are composed of air suction ducts (second suction means) 14*a*, 14*b* connected appropriately to a dust collector body 30 by hoses 17*a* to 17*d* (see FIG. 1). On the guide surface of the air discharge duct 13, the blowoff holes 15 for blowing off air laterally rightward and leftward are formed in large numbers, symmetrically with respect to a central line in the right-and-left direction. Air blown off through the blowoff holes 15 floats the sheet 3 being transported. On the guide surface of each of the air suction ducts 14*a*, 14*b*, suction holes 16 are formed in large numbers to be able to suck and recover a surplus powder (to be described later) into the ducts.

Above the transport path of the sheet 3 in a rising portion of the delivery chain 8 starting at its beginning end portion and heading obliquely upward, a spray pipe 18 connected to the air supply source (not shown) is supported between the right and left frames 6. On the spray pipe 18, a plurality of spray nozzles (powder spraying means) 19 are arranged parallel to spray a powder over the sheet 3 being transported.

The spray pipe 18 and the spray nozzles 19 are covered with a casing-shaped cover 20 supported between the right and left frames 6 and having a lower surface (the surface opposed to the sheet 3 being transported) open. On the front and rear wall surfaces of the cover 20, brushes 21 are mounted nearly throughout the widths of the front and rear wall surfaces, with the implanted bristles of the brushes making sliding contact with the gripper bars 10 and the gripper devices 11 which are running. Thus, the powder is sprayed toward the printed surface of the sheet 3 traveling within the range surrounded by the cover 20 and the brushes 21.

Downstream of the spray nozzles 19 in the sheet transport direction and above the transport path of the sheet 3, a blowing device (blowing means) 22 is supported between the right and left frames 6 for blowing air nearly parallel to the printed surface of the sheet 3 being transported and toward an upstream side in the sheet transport direction. The blowing device 22 comprises a plurality of (six in FIG. 3) gripper bar-opposed fans 23*a* to 23*f* connected together in the direction of the sheet width, as shown in FIG. 3.

The gripper bar-opposed fans 23*a* to 23*f* have a rotational speed controlled by a control device, as shown in FIG. 4, to be interlocked to the printing speed. In detail, the rotational speed of the gripper bar-opposed fans 23*a* to 23*f*, which is based on printing press rotation information from a printing speed detector, such as a rotary encoder, incorporated in a plate cylinder provided in the printing unit, is calculated by a computing device with the use of proper value function database rendered ready for use. Based on the results of the calculation, the control device outputs a drive signal to a motor for the gripper bar-opposed fans 23*a* to 23*f*.

Above a portion of the transport path of the sheet 3 located nearly intermediate between the spray nozzles 19 and the blowing device 22, a suction duct 24 (first suction means) is supported between the right and left frames 6 for sucking not only air blown by the blowing device 22, but also the surplus powder which has been blown off from the spray nozzles 19 and leaked out of the range surrounded by the cover 20 and the brushes 21. The suction duct 24 is connected, as appropriate, to the dust collector body 30 via a hose 17*e*. The suction duct 24 has a multi-hole plate 24*a* pointed toward the upstream side in the sheet transport direction, the multi-hole plate 24 having suction holes.

A blower, a filter, etc. are housed within the dust collector body 30, constituting a dust collection apparatus of a general type called a bag filter. In FIG. 1, numeral 25 denotes an upper shielding plate, numeral 26 denotes a brush for removing the powder deposited on the gripper bars 10 and the gripper devices 11, and numeral 27 denotes an air blowing device comprising fans.

Because of the above-described features, the sheet 3 printed by the printing units 2A to 2D is transferred from the gripper devices provided in the final cylinder of the printing unit 2D to the gripper devices 11 of the delivery chains 8 by gripping change. Then, as the delivery chains 8 travel, the sheet 3 is transported, with its printed surface directed upward, while being guided by the sheet guides 12A to 12C. In the transport end zone, the sheet 3 is released from gripping by the gripper devices 11, dropped and placed on the pile on the pile board 5.

The sheet 3 in the above-mentioned delivery action has just undergone printing, and thus has the printed surface not yet dried. However, the printed surface of the sheet 3 has been sprayed with the powder ejected through the spray nozzles 19 at the rising portion of the delivery chain 8. Hence, the setoff (so-called blocking) of the sheet 3 does not take place with respect to the sheet 3 placed next on the pile board 5 in the transport end zone.

In spraying the powder from the spray nozzles 19, a surplus powder not adhering to the printed surface of the sheet 3 scatters within the range surrounded by the cover 20 and the brushes 21, but most of the scattered surplus powder is sucked by the suction ducts 14*a*, 14*b* of each of the sheet guides 12A, 12B, and is recovered into the dust collector body 30.

For the surplus powder borne by a strong airflow (see Karman vortices α, β in FIG. 7), which has been created by the continuous travel of the gripper bars 10, and carried beyond the range surrounded by the cover 20 and the brushes 21, a certain wall is constructed by air blown from the blowing device 22, whereby the surplus powder is inhibited from flowing out any further toward a downstream side in the sheet transport direction. In detail, air with a power comparable to or stronger than the travel speed of the gripper bars 10 is blown in to brake the airflow generated by the gripper bars 10, thereby stagnating the surplus powder for a certain period of time. Consequently, the surplus powder is efficiently sucked by the suction duct 24 and the suction ducts 14*a*, 14*b* of the sheet guides 12B, 12C, and is recovered into the dust collector body 30.

The above-described blowing-in of air also has the effect of releasing the surplus powder, which has been entrained by the Karman vortices α, β of the aforementioned airflow, by eliminating the Karman vortices α, β, and then leading the released surplus powder into the suction duct 24 and the suction ducts 14*a*, 14*b* of the sheet guides 12B, 12C. Furthermore, the surplus powder in floating state, which has not been caught by the airflow caused by the gripper bars 10, can be promptly recovered by the suction duct 24, because the suction holes of the suction duct 24 are directed toward the upstream side in the sheet transport direction. Besides, the floating surplus powder can be prevented by the blowing device 22 from flying rearward of the position where the blowing device 22 is installed. Such a surplus powder is also guided effectively toward the suction duct 24 and the suction ducts 14*a*, 14*b* of the sheet guides 12B, 12C.

In the above-described manner, the amount of the surplus powder, which has been borne by the airflow created by the travel of the gripper bars 10, and carried toward the downstream side in the sheet transport direction, is effectively decreased, and the dust collecting effect is enhanced. Thus, the surplus powder, which has scattered in the delivery 4 and its surroundings to contaminate the environment, decreases in amount, and the surplus powder deposited within the machine is also decreased by a considerable amount. As a result, the appearance of the periphery of the machine is kept in an orderly state, and the risk of causing troubles, such as lumpy deposits, is decreased.

In the foregoing embodiment, the blowing device 22 may be nozzle-type air blowing means other than the gripper bar-opposed fans 23*a* to 23*f*. The gripper bar-opposed fans 23*a* to 23*f* may be arranged in a plurality of rows, as well as in a single row (see FIG. 3). The location, direction, and shape of the suction duct 24 are not limited to those shown in the illustrated embodiment, but can be set to be an arbitrary location, an arbitrary direction, and an arbitrary shape. Moreover, the direction of mounting of the gripper bar-opposed fans 23*a* to 23*f* is basically nearly parallel to the direction of movement of the gripper bars 10, but in some cases, the gripper bar-opposed fans 23*a* to 23*f* may have some angle of elevation.

Embodiment 2

Figure 6:
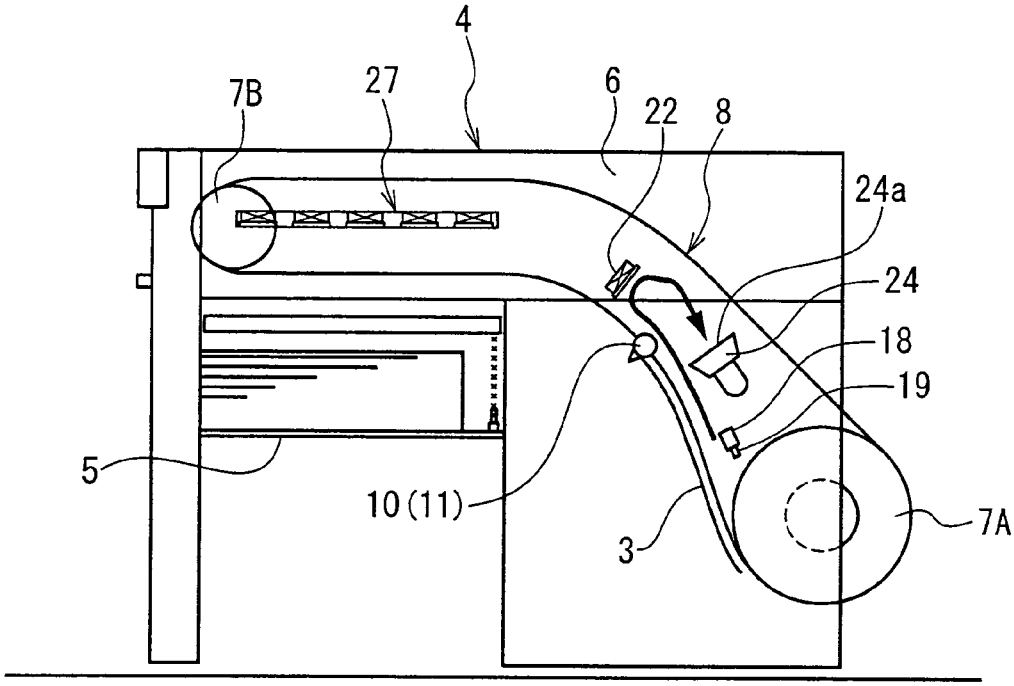
FIG. 6 is a detail side view of a delivery of the sheet-fed rotary press showing Embodiment 2 of the present invention.

FIG. 6 is a detail side view of a delivery of the sheet-fed rotary press showing Embodiment 2 of the present invention.

This is an embodiment in which the spray pipe 18 and the spray nozzles 19 in Embodiment 1 are not covered with the cover 20 and the brushes 21, and the multi-hole plate 24*a* provided on the suction duct 24 and having suction holes is directed toward a downstream side in the sheet transport direction. The illustration of the sheet guides 12A to 12C is omitted here.

According to the present embodiment, the direction of the powder, which flows from the upstream side to the downstream side in the sheet transport direction, can be changed by the blowing device 22 such that the powder will head toward the upstream side in the sheet transport direction. Furthermore, the suction holes of the suction duct 24 are pointed toward the downstream side in the sheet transport direction, so that the powder can be directly sucked by the suction duct 24. Consequently, the same actions and effects as those in Embodiment 1 can be obtained, and the simplification and cost reduction of the devices can be achieved because of a decrease in the number of components.

While the present invention has been described by the foregoing embodiments, it is to be understood that the invention is not limited thereby, but may be varied in many other ways. For example, the dust collection apparatus of a printing press according to the present invention can be applied to a printing press other than a sheet-fed rotary press. Such variations are not to be regarded as a departure from the spirit and scope of the invention, and all such modifications as would be obvious to one skilled in the art are intended to be included within the scope of the appended claims.

What is claimed is:

1. A dust collection apparatus of a printing press, comprising:

sheet transport means equipped with sheet holding means for holding a printed sheet;

powder spraying means for spraying a powder toward a printed surface of said sheet being transported by said sheet transport means;

blowing means, provided downstream of said powder spraying means in a sheet transport direction, for blowing air nearly parallel to said printed surface of said sheet being transported and toward an upstream side in said sheet transport direction;

first suction means, provided upstream of said blowing means in said sheet transport direction, for sucking said powder along with air blown by said blowing means, said first suction means being provided downstream of said powder spraying means in said sheet transport direction; and a casing-shaped cover, whose surface that opposes the sheet being transported is open, and which covers the powder spraying means, wherein the blowing means and the first suction means are disposed outside the cover.

2. The dust collection apparatus of a printing press according to claim 1, further comprising:

a dust collector body, wherein said first suction means is connected to said dust collector body.

3. The dust collection apparatus of a printing press according to claim 1, further comprising:

second suction means, provided at positions opposing lateral end portions of said sheet being transported by said sheet holding means, for sucking said powder.

4. The dust collection apparatus of a printing press according to claim 3, further comprising:

a sheet guide portion, provided between said second suction means, for guiding said sheet being transported, said sheet guide portion having discharge holes for discharging air to said second suction means which are closer to said sheet guides with respect to a nearly central portion thereof.

5. The dust collection apparatus of a printing press according to claim 3, further comprising:

a dust collector body, wherein said second suction means are connected to said dust collector body.

6. The dust collection apparatus of a printing press according to claim 1, wherein suction holes of said first suction means are directed toward an upstream side in said sheet transport direction.

7. The dust collection apparatus of a printing press according to claim 1, wherein suction holes of said first suction means are directed toward a downstream side in said sheet transport direction.

8. The dust collection apparatus of a printing press according to claim 1, wherein said blowing means is fans rotationally driven by a motor, and said motor has a speed controlled in accordance with a printing speed of said printing press.

9. The dust collection apparatus of a printing press according to claim 1, further comprising:

brushes provided upstream of said powder spraying means in said sheet transport direction and downstream of said powder spraying means in said sheet transport direction.

10. The dust collection apparatus of a printing press according to claim 4, wherein said blowing means, said first suction means, and said powder spraying means are provided to face a first surface of said sheet being transported by said sheet holding means, while said sheet guide portion and said second suction means are provided to face a second surface of said sheet opposite to the first surface.

11. The dust collection apparatus of a printing press according to claim 4, wherein the sheet guide portion includes a plurality of independent sheet guides provided along a transporting direction of the sheet, each sheet guide being provided with said discharge hole.

12. The dust collection apparatus of a printing press according to claim 9, wherein a brush provided downstream of said powder spraying means is provided upstream of said first suction means.

* * * * *